United States Patent [19]

Adachi

[11] 3,972,258

[45] Aug. 3, 1976

[54] AUTOMATIC RHYTHM PERFORMANCE SYSTEM

[75] Inventor: Takeshi Adachi, Hamamatsu, Japan

[73] Assignee: Nippon Gakki Seizo Kabushiki Kaisha, Japan

[22] Filed: Nov. 1, 1974

[21] Appl. No.: 520,349

[30] Foreign Application Priority Data

Nov. 7, 1973 Japan ..... 48-125088

[52] U.S. Cl. ..... 84/1.03; 84/DIG. 12

[51] Int. Cl.² ..... G10H 1/00; G10H 5/00

[58] Field of Search ..... 84/1.01, 1.03, 1.17, 84/1.24, DIG. 12, DIG. 22

[56] References Cited

UNITED STATES PATENTS

| | | | |
|---|---|---|---|
| 3,247,309 | 4/1966 | Campbell | 84/1.17 |
| 3,358,069 | 12/1967 | Hearne | 84/1.03 |
| 3,433,880 | 3/1969 | Southard | 84/1.17 |
| 3,439,569 | 4/1969 | Dodds et al. | 84/DIG. 12 |
| 3,629,480 | 12/1971 | Harris | 84/1.03 |
| 3,789,718 | 2/1974 | Bunger | 84/1.01 |
| 3,832,479 | 8/1974 | Aliprandi | 84/1.03 |

*Primary Examiner*—L. T. Hix
*Assistant Examiner*—Stanley J. Witkowski
*Attorney, Agent, or Firm*—Robert E. Burns; Emmanuel J. Lobato; Bruce L. Adams

[57] ABSTRACT

An automatic rhythm performance system is provided with a rhythm pattern changing circuit comprising a white noise source and a sample hold circuit which samples the output of the white noise source in response to a pulse signal occurring at the beginning of every measure of a rhythm to produce a sustained voltage of a sampled value which will be different for every measure. The sample hold circuit voltage is applied to a rhythm selecting circuit to modify the preselected pattern of the rhythm.

5 Claims, 4 Drawing Figures

AUTOMATIC RHYTHM PERFORMANCE SYSTEM

BACKGROUND OF THE INVENTION

This invention relates to automatic rhythm performance systems, and more particularly to an improvement of the effects of the automatic rhythm performance system.

In all of the conventional automatic rhythm performance systems, the colors and pitches of percussion tones forming rhythm tones are fixed for one rhythm, that is, the colors and pitches of the rhythm tones are maintained unchanged, or cannot be changed. Accordingly, the rhythm performance by the conventional automatic rhythm performance system is rather monotonous. In general, if a musical performance is continued in the same rhythm for a long period, audiences will be tired of listening to such a monotonous rhythm performance. The rhythm performance by the conventional system is therefore liable to render unpleasant and uninteresting the performance of musical instruments which are played along with the rhythm performance by the conventional automatic rhythm performance system.

SUMMARY OF THE INVENTION

Accordingly, an object of this invention is to provide an improved automatic rhythm performance system which can possibly overcome the above-described disadvantage accompanying the conventional automatic rhythm performance system, that is, the monotony of rhythm tones.

The nature, utility and principle of this invention will be more clearly understood from the following description and the appended claims when read in conjunction with accompanying drawings.

DETAILED DESCRIPTION OF THE INVENTION

Figure 1:
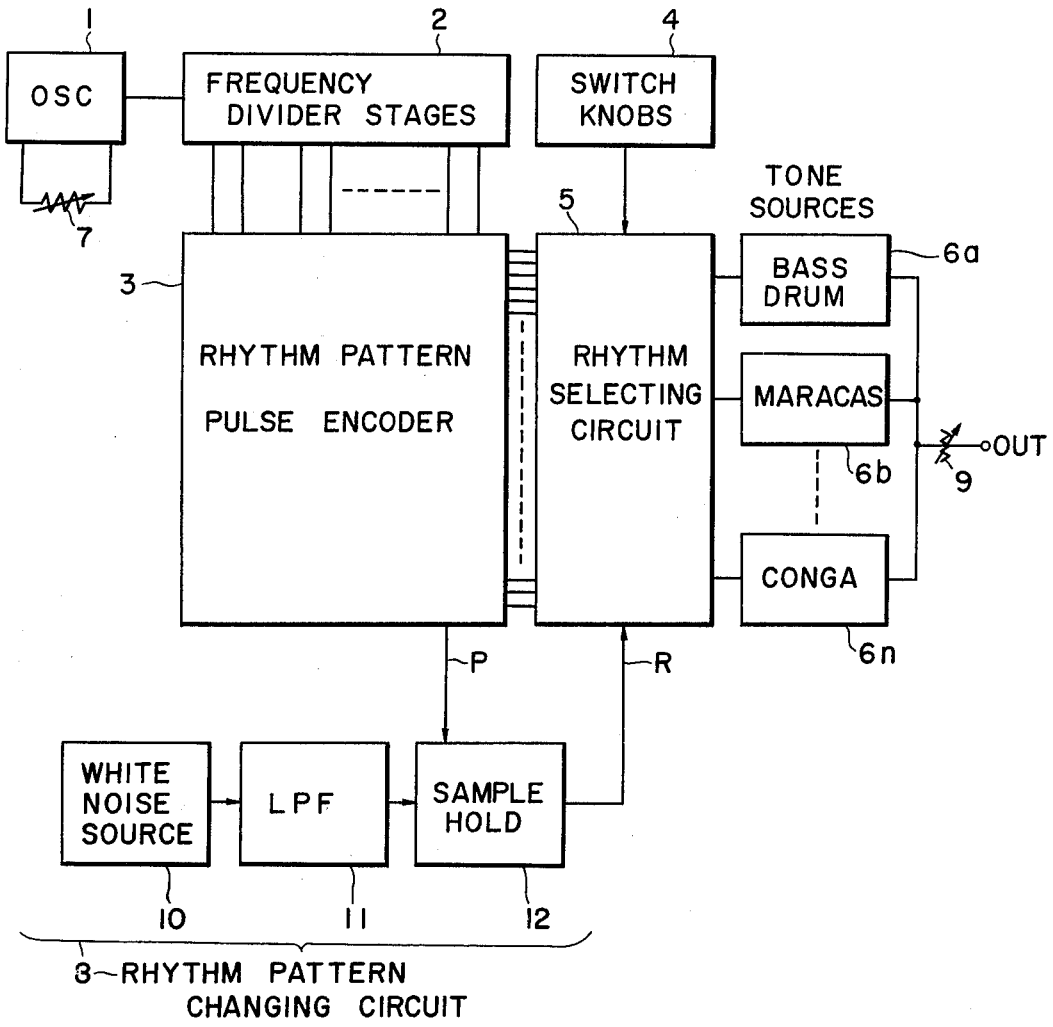
FIG. 1 is a block diagram indicating one example of an automatic rhythm performance system according to this invention.

One embodiment of an automatic rhythm performance system according to this invention is shown in FIG. 1 which comprises a basic tempo oscillator 1 which produces the frequency output which determines a tempo, a frequency division section or divider 2 which is provided with a number of frequency dividers, a rhythm pattern pulse encoder 3, a rhythm selecting circuit 5, and percussion tone sources *6a–6n*, namely, for instance a bass drum tone source *6a*, a maracas tone source *6b*, — and a conga tone source *6n*.

The frequency output of the oscillator 1 is applied to the frequency division section 2, which produces a plurality of frequency division outputs having different frequencies. These frequency division outputs are combined together in the rhythm pattern pulse encoder 3 to produce a variety of rhythm patterns. Oscillator 1, frequency divider 2 and rhythm pattern pulse encoder 3 jointly define a rhythm pattern forming circuit. Out of the rhythm patterns thus produced a desired one is selected by the rhythm selecting circuit 5 in response to the manipulation of rhythm selecting switch knobs 4. The rhythm selecting circuit 5 produces trigger pulse signals which are employed to enable tone sources *6a–6n* to produce percussion tones (such as bass drum, maracas, claves and conga tones) comprising the rhythm pattern selected. These trigger pulse signals are applied to the percussion tone sources, which produce percussion tone signals at their respective output terminals, in response to the trigger pulse signals. The percussion tone signals thus produced are mixed and applied to a rhythm signal output terminal OUT. In FIG. 1, reference numeral 7 designates a tempo controlling variable resistor, connected to the basic tempo oscillator 1, and reference numeral 9 designates a variable resistor for changing tone signal output levels.

The above-described construction of the automatic rhythm performance system is known in the art. For example, the rhythm pattern pulse encoder 3 is disclosed in U.S. Pat. No. 3,358,068. This conventional construction of the rhythm performance system is improved, according to the invention, by adding a rhythm pattern changing circuit 8 which operates to change the pattern of a rhythm selected by the rhythm selecting switch knobs 4.

This rhythm pattern changing circuit 8 comprises a white noise source or wideband noise source 10 and a sample hold circuit 12 which is connected through a low-pass filter 11 to the output terminal of the white noise source. This sample hold circuit 12 receives from the rhythm pattern forming circuit 3 trigger signals P comprised of pulses each indicating the beginning of a measure (hereinafter referred to as "measure signals P"), as sampling signals and samples the voltage values of the white noise voltage from the circuit 11 at the moments determined by the pulses comprising the measure signals P and continuously produces sustained voltages R which are applied, as pattern modifying signals, to the rhythm selecting circuit 5.

Figure 2:
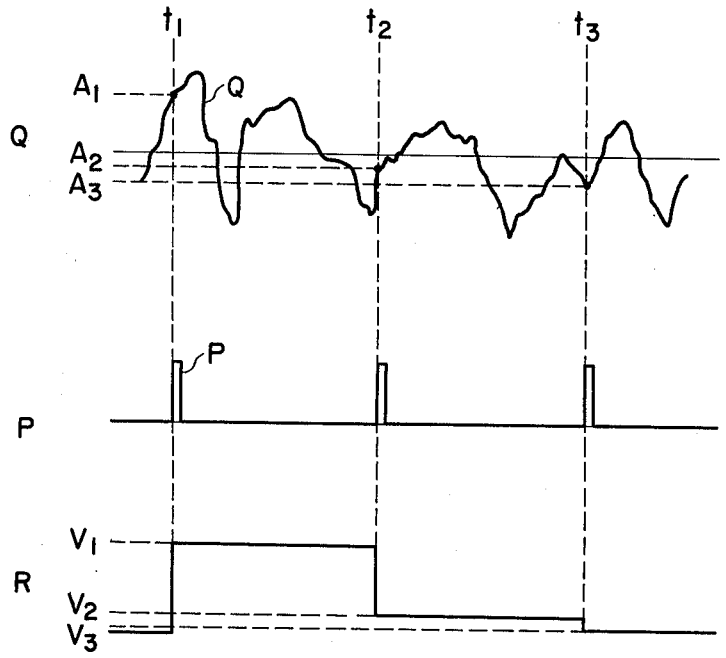
FIG. 2 is a graphical representation indicating signal waveforms which are used for the description of a sample hold circuit employed in the system shown in FIG. 1.

As is indicated by reference character P in FIG. 2, the measure signals P are pulse signals which have a predetermined pulse width and occur at the start of each measure at the times $t_1$, $t_2$, $t_3$ and so forth. The sample hold circuit 12 is, for instance, a charge-discharge circuit having a capacitor.

As is indicated in FIG. 2, the instantaneous voltage values of a white noise signal introduced to the circuit 12 through the low-pass filter 11 have voltage levels $A_1$, $A_2$ and $A_3$ respectively at the time instants $t_1$, $t_2$ and $t_3$ corresponding to the occurrence of the measure signals P. These voltages charge the charge-discharge circuit during the pulse intervals of the measure signals P in the circuit 12, as a result of which the circuit 12 produces at its output terminal sustained constant voltages $V_1$, $V_2$ and $V_3$ in response to the voltage levels $A_1$, $A_2$ and $A_3$, as is indicated by reference character R in FIG. 2. A sample hold circuit suitable for use in the present invention is disclosed in copending U.S. patent application Ser. No. 448,583 filed March 6, 1974 and assigned to the assignee of the present application, and the book *Field-Effect Transistors* by L. J. Sevin, Jr. McGraw-Hill (1965).

The rhythm selecting circuit 5 is so designed that, when the pattern modifying signal R is applied thereto, it changes the rhythm pattern selected by the rhythm selecting switch knobs 4.

Figure 3:
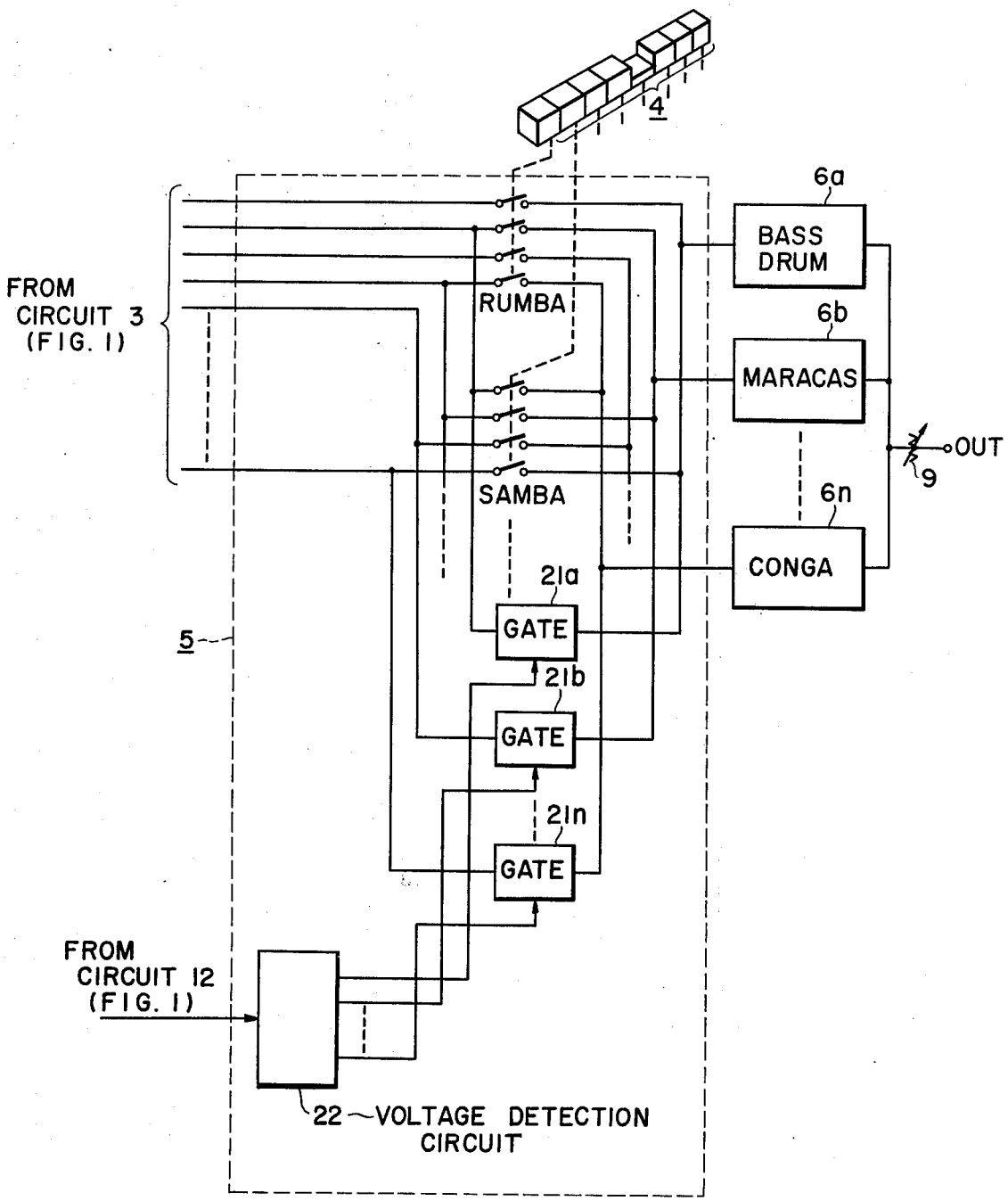
FIG. 3 is a block diagram showing a rhythm selecting circuit in the system shown in FIG. 1.

More specifically, as is illustrated in FIG. 3, the rhythm selecting switch knobs 4 are a number of push buttons which are provided for the respective rhythms, and each of the push buttons is coupled with a group of switch contacts which are included in the rhythm selected circuit 5. Out of the plurality of pulse signals having different patterns and being applied through the contacts from the rhythm pattern pulse encoder circuit 3, pulse signals having patterns which meets a desired or selected rhythm are applied to the percussion tone source circuits.

Thus, the rhythm signals selected by the rhythm selecting circuit 5, as was described above, are provided at the output terminal OUT (FIG. 1).

More particularly, in this invention, the rhythm selecting circuit 5 further comprises a plurality of gate circuits 21*a*, 21*b* – 21*n* ones of which are provided for the respective percussion tone sources 6*a*, 6*b* – 6*n*. More specifically, the gate circuits 21*a*, 21*b* – 21*n* are connected so as to receive the pattern pulse signals, predetermined according to the kinds of rhythms, which are introduced from the rhythm pattern pulse encoder 3, and the output terminals of the gate circuits 21*a*, 21*b* – 21*n* are connected to the percussion tone sources 6*a*, 6*b*, – 6*n*, respectively.

The rhythm selecting circuit 5 further comprises a voltage detection circuit 22 which receives the sampled voltages from the sample hold circuit 12 and produces gate control signals to control the operations of the gate circuits 21*a*, 21*b*–, and 21*n*.

Figure 4:
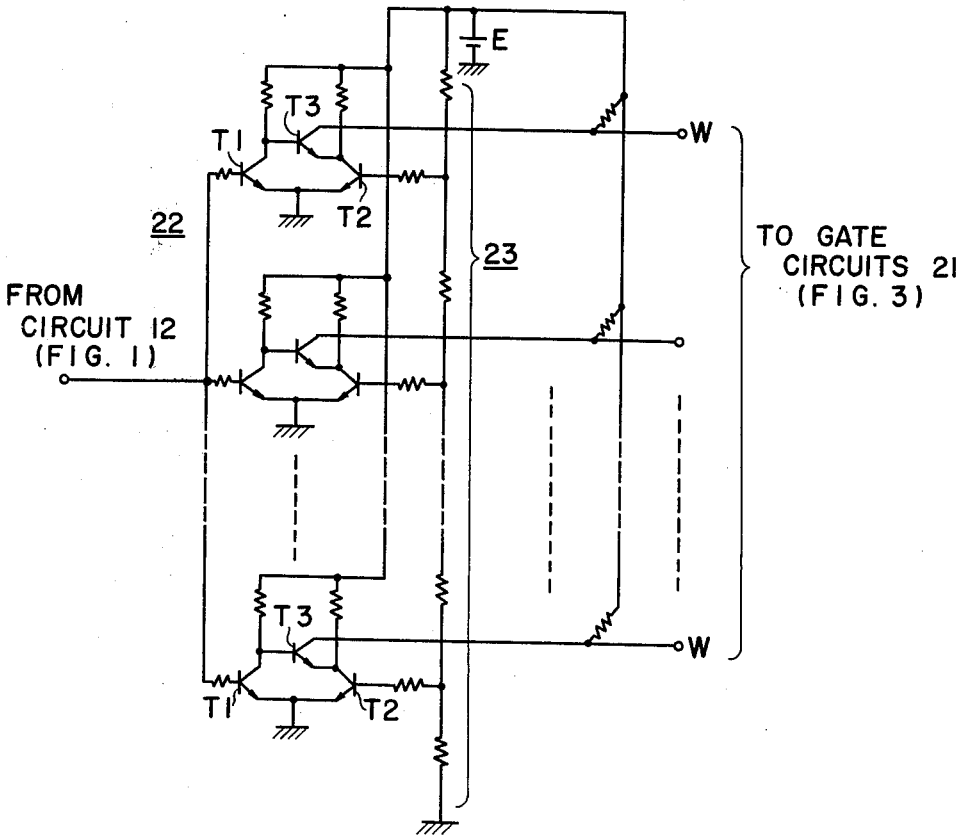
FIG. 4 is a circuit diagram indicating a voltage detection circuit in the rhythm selecting circuit shown in FIG. 3.

The voltage detection circuit 22 is constructed, as is shown in FIG. 4, of a plurality of voltage comparison circuits each having a pair of emitter grounded transistors $T_1$ and $T_2$ and an output transistor $T_3$. The base, emitter and collector of this output transistor $T_3$ are connected to the collector of the transistor $T_1$, the collector of the transistor $T_2$ and the output terminal W of the voltage comparison circuit, respectively.

The sustained constant voltage levels from the sample hold circuit 12 are applied to the base of the transistor $T_1$, while a reference voltage is applied to the base of the transistor $T_2$ through a voltage divider circuit 23 connected in parallel with a power source E. As is apparent from the circuit of FIG. 4, different reference voltages are applied to different transistors $T_2$.

In each of the voltage comparison circuits, when the voltage applied to the transistor $T_1$ becomes higher than the reference voltage, the transistor $T_1$ is rendered conductive while the transistor $T_2$ is rendered non-conductive. As a result, the output transistor $T_3$ is rendered non-conductive. Thus, a gate opening signal arising from a low voltage level to a high voltage level is delivered to the output terminal W.

Since the automatic rhythm performance system is organized as described above, whenever the measure signal P (FIG. 2) is provided by the rhythm pattern forming circuit 3 at the time instant $t_1$, $t_2$, $t_3$, —, the voltage sampled by the circuit 12 varies in response to the output of the white noise voltage source 10 at the time instant $t_1$, $t_2$, $t_3$ and so forth, and in response to this variation the gate opening signal delivered from the voltage detection circuit 22 (FIG. 3) is also changed (in the case of FIGS. 3 the number of the gate opening signals being changed). Accordingly, the trigger signals for the percussion tone sources coupled with the gate circuits which are now opened in addition to the trigger signal for the percussion tones selected by the rhythm selecting circuit 5 are obtained at the output terminals of the rhythm selecting circuit 5. A rhythm signal comprised of, the rhythm signal whose rhythm pattern is changed at every measure and the rhythm signal having a rhythm selected by the rhythm selecting circuit 5 is delivered to the rhythm signal output terminal OUT.

Thus, according to this invention, the same rhythm pattern is not merely repeated, but changed at random while always including the rhythm selected by the rhythm selecting switch knob 4. That is, this invention can provide an automatic rhythm performance system capable of overcoming the monotony which is the disadvantage accompanying the conventional automatic rhythm performance system.

This invention has been described in connection with the case where the measure signal P sampling pulses occur at the beginning of every measure. However, it is not always necessary for the signal P to occur at the beginning of the measure; that is, the rhythm pattern forming circuit may be modified so that the signal P occurs at a time other than the beginning of each measure as mentioned above.

Furthermore, the sampling signal is obtained for every measure in the above description, however, the rhythm pattern forming circuit may be so designed that the sampling signal may occur for every plurality of measures or may occurs with a period having no connection with the period of the measure.

In addition, the invention has been described in connection with the case that the gate circuits 21*a* through 21*n* are provided for the percussion tone sources respectively. However, some of the gate circuits may be eliminated or a plurality of gate circuits may be provided for one percussion tone source, if necessary.

I claim:

1. In an automatic rhythm performance system of the type comprising a rhythm pattern forming circuit for developing rhythm pattern signals representative of a variety of rhythm patterns; a rhythm selecting circuit receptive of said rhythm pattern signals and operable for selecting different ones of the received rhythm pattern signals; and a plurality of percussion tone generating sources responsive to rhythm pattern signals and connected to said rhythm selecting circuit for receiving said selected rhythm pattern signals to develop percussion tone signals having rhythms determined by said selected rhythm pattern signals; the improvement which comprises: said rhythm selecting circuit comprising means responsive to external electrical signals for applying to said percussion tone sources ones of said rhythm pattern signals determined by said electrical signals; and means for applying randomly occurring electrical signals to said means responsive to external electrical signals to enable said rhythm selecting circuit to apply random ones of said rhythm pattern signals to said percussion tone generating sources in response to the occurrences of said randomly occurring signals in order to develop percussion tone signals having rhythms determined by said selected rhythm pattern signals and by the occurrences of said randomly occurring electrical signals.

2. In an automatic rhythm performance system of the type comprising a rhythm pattern forming circuit for developing rhythm pattern signals representative of a variety of rhythm patterns; a rhythm selecting circuit receptive of said rhythm pattern signals and operable for selecting rhythm pattern signals representative of any of the rhythms of said variety of rhythm patterns; and a plurality of percussion tone generating sources responsive to the rhythm pattern signals and connected to the rhythm selecting circuit for receiving the selected rhythm pattern signals to develop percussion tone signals having rhythms determined by the selected rhythm pattern signals; the improvement which comprises: a rhythm pattern changing circuit comprised of a wideband noise source for developing an output noise signal having randomly occurring amplitude variations, and a sample-hold circuit receptive of the noise source output signal for developing a voltage output comprised of a sequence of constant random amplitude voltage levels proportional to the value of the noise source output signal amplitude at a sequence of sampling times and for applying the sequence of constant random amplitude voltage levels to the rhythm selecting circuit; and wherein the rhythm selecting circuit includes means responsive to the sequence of constant random amplitude voltage levels for selecting different ones of the rhythm pattern signals according to the values of the constant random amplitude voltage levels in order to develop percussion tone signals having rhythms determined by the selected rhythm pattern signals and by the sequence of constant random amplitude voltage levels.

3. In an automatic rhythm performance system according to claim 2, wherein the rhythm pattern forming circuit develops a rhythm pattern signal comprised of a sequence of pulses each occurring at the beginning of consecutive measures of the rhythm being performed, and wherein the sample-hold circuit includes means for receiving the sequence of pulses for enabling the sample-hold circuit to sample the output of the noise source at the instant each pulse is received.

4. In an automatic rhythm performance system according to claim 2, wherein the means responsive to the sequence of constant voltage levels comprises: a plurality of gate circuits each connected between the rhythm pattern forming circuit and a respective one of the percussion tone generating sources for applying rhythm pattern signals to the percussion tone generating sources; and a voltage detection circuit receptive of the sequence of constant voltage levels and connected to the gate circuits for producing gate control signals representative of the values of the sequence of constant voltage levels for enabling different ones of the gates as the values of the sequence of constant voltage change, thereby to apply different ones of the rhythm pattern signals to different ones of the percussion tone generating sources.

5. An automatic rhythm performance system according to claim 4, wherein the voltage detection circuit comprises: a plurality of voltage comparison circuits each connected to a respective one of the gate circuits and to the rhythm pattern changing circuit; a reference voltage source and; a voltage divider circuit connected to the reference voltage source and to the voltage comparison circuits for applying a different reference voltage to each of the voltage comparison circuits whereby different ones of the gate circuits are enabled when the value of the sequence of constant voltage levels exceeds different values.

* * * * *